US005803844A

United States Patent [19]

Anderson

[11] Patent Number: 5,803,844

[45] Date of Patent: Sep. 8, 1998

[54] RING ACTUATED ARROWHEAD

[76] Inventor: Jeffrey J. Anderson, 71 Ravine Lake Rd., Bernardsville, N.J. 07924

[21] Appl. No.: 865,398

[22] Filed: May 29, 1997

[51] Int. Cl.[6] ..... F42B 6/08

[52] U.S. Cl. ..... 473/583

[58] Field of Search ..... 473/582–585, 473/219–222; 43/6

[56] References Cited

U.S. PATENT DOCUMENTS

| | | | |
|---|---|---|---|
| 4,615,529 | 10/1986 | Vocal . | |
| 4,976,443 | 12/1990 | DeLucia | 473/583 |
| 5,078,407 | 1/1992 | Carlston et al. . | |
| 5,112,063 | 5/1992 | Puckett . | |
| 5,178,398 | 1/1993 | Eddy | 473/583 |
| 5,458,341 | 10/1995 | Forrest et al. . | |
| 5,478,089 | 12/1995 | Austin | 473/582 |
| 5,564,713 | 10/1996 | Mizek et al. . | |

*Primary Examiner*—Mark S. Graham
*Attorney, Agent, or Firm*—Gibbons, Del Deo, Dolan, Griffinger and Vecchione

[57] ABSTRACT

An arrowhead for an arrow that utilizes a blade locking ring for retaining and releasing a set of expandable blades. The arrow has a slotted ferrule for rotatably attaching a set of expandable blades. Each expandable blade has a ear having a notch and a rim for holding the blade locking ring in a retaining and releasing position, respectively. The rim is dimensioned in view of the width of the blade locking ring, so that outward projections are minimized. Operationally, the tip of the arrow penetrates a given distance before actuation of the releasing mechanism, so that the expandable blades open within the body of the animal. The skin of the target displaces the blade locking ring from the notch to the rim, causing the blades to pivot outward. As such, the impact force is maximized to inflict greater damage inside the animal, therefore increasing the chances of getting a kill. The blade locking ring is pushed onto the arrow shaft for reuse by the hunter.

18 Claims, 1 Drawing Sheet

RING ACTUATED ARROWHEAD

FIELD OF THE INVENTION

This invention relates to the field of archery and hunting, and in particular, to arrowheads with expandable blades.

BACKGROUND OF THE INVENTION

When hunting game with bow and arrows, the perfect arrowhead would be one that has the flight characteristics of a dart-type configuration and has the cutting ability of a bladed configuration. Although various prior art arrowheads attempt to provide both characteristics, the designs have limited penetration ability. Broadhead and expandable broadhead are two arrowhead categories that attempt to provide both characteristics.

A broadhead is an arrowhead that has an extended blade arrangement. As a consequence, arrows equipped with broadheads inflict more extensive damage to the target, for example, a deer. Although the extended blade arrangement has a greater chance of obtaining a kill upon impact with the target, the configuration is susceptible to the adverse effects of wind shear. Specifically, the wind acts on the extended blades to alter the flight of the arrow, thereby decreasing the accuracy of the arrow. Furthermore, the lack of an aerodynamic profile decreases the speed at which the arrow travels. The lack of speed translates into a decreased level of penetration into the target and decreases the chances of a kill with the extended blade arrangement.

Another group of prior art devices, expandable broadheads, attempts to solve the above problems by utilizing the concept of expandable blades. In general, the expandable blades are in a closed position during the flight of the arrow and expand radially outward from the arrow shaft upon impact with the target. Various designs and mechanisms for retaining and releasing the expandable blades are illustrated in the prior art. A drawback of these prior art designs is that they utilize complex mechanisms for retaining the blades during flight and releasing the blades at impact. For example, some of the prior art devices employ plunger mechanisms at the forward section of the arrow and camming surfaces near the back of the arrow to release the retracted blades. Other prior art devices utilize spurs or side extensions to release the blades. In these devices, the spurs use the target skin as a pivoting surface to rotate the blades to the open position. This partially hidden configuration retains some of the problems associated with non-expandable broadhead designs. A disadvantage of both expandable broadhead designs is that part of the force generated from the mass and acceleration of the arrow is transferred to the releasing mechanism at the point of impact. Since most of the prior art devices involve multiple moving parts, this could require a relatively substantial portion of the impact force. This redistribution of the force at the impact point results in decreased penetration of the target. This decreases the effectiveness of the arrow in inflicting damage to the target and in obtaining a kill.

Accordingly, there is a need to provide a simple and effective mechanism which retains a set of blades in a closed position, yet requires minimal force to permit release of the blades within the target.

SUMMARY OF THE INVENTION

The present invention teaches a device that maintains a low aerodynamic profile during the flight of the arrow and through the point of impact by providing a ring actuated retaining and releasing mechanism. The effects of wind shear are minimized due to the tapered and unobtrusive design of the present invention. Importantly, a greater portion of the impact force is utilized for penetration into the target, since a minimal portion of the impact force is needed in releasing the blades.

In an exemplary embodiment of the present invention, an arrow has a set of blades rotatably attached to a slotted ferrule. Each blade has an ear having a notch and a rim for holding a blade locking ring in a retaining and releasing position, respectively. Advantageously, the structure of the present invention minimizes outward projections by dimensioning the size of the rim to that of the blade locking ring. Consequently, an arrow equipped with an arrowhead of the present invention flies a true and accurate path. Importantly, the tip of the arrow penetrates a given distance before actuation of the releasing mechanism, so that the expandable blades open within the body of the animal. As such, the impact force is maximized to inflict greater damage inside the animal, therefore increasing the chances of getting a kill.

Advantageously, the blade locking ring of the present invention can be reused by the hunter for the next attempt. The above factors make the present arrowhead a simple, accurate and effective device for hunting game.

BRIEF DESCRIPTION OF THE DRAWINGS

A more complete understanding of the present invention may be obtained from consideration of the following description in conjunction with the drawings in which:

FIG. 1(*b*) is a top view of the embodiment shown in FIG. 1(*a*);

FIG. 1(*c*) is a detailed illustration of a ring retaining and releasing mechanism in accordance with the present invention;

FIG. 1(*d*) is an exemplary embodiment of a blade coupling mechanism used in accordance with the principles of the invention;

FIG. 1(*e*) is an exemplary embodiment of a blade locking ring in accordance with the present invention;

FIG. 1(*f*) is another embodiment of a blade locking ring in accordance with the present invention;

FIG. 2(*a*) is a top view of the embodiment illustrated in FIG. 2;

DETAILED DESCRIPTION

The present invention is an arrowhead utilizing a retaining and releasing mechanism that maintains expandable blades in a closed position during flight and advances rotation of the expandable blades to an open position when the mechanism impacts the target. The closed blade position evinces a low aerodynamic profile during the flight of the arrow and through the point of impact. As a consequence, the arrow flies true and maximizes the energy deposited at the impact point. As a result of the present design, a minimal portion of the impact force is needed in releasing the blades. This permits greater penetration into the animal and increases the chances of a kill.

Figure 1B:
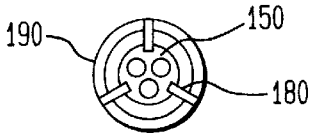
FIG. 1(*a*) is an exemplary embodiment of an arrowhead in accordance with the present invention.
Figure 1E:
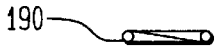
Figure 1C:
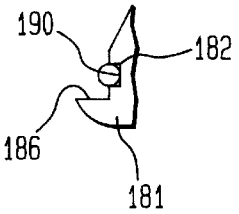
Figure 1A:
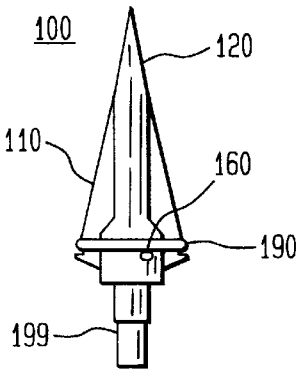
Figure 1F:
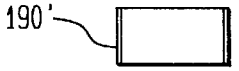
Figure 1D:
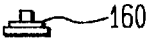
Figure 2:
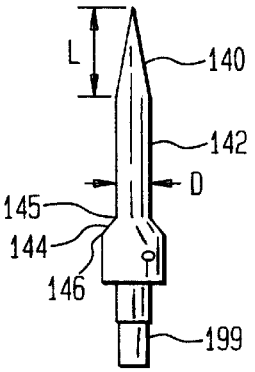
FIG. 2 is an exemplary embodiment of tip and body portions used in accordance with the principles of the invention.
Figure 2A:
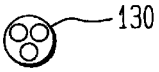

Referring to FIGS. 1(*a*) and 1(*b*), there is shown an exemplary embodiment of an arrow 100 equipped with an arrowhead 110 in accordance with the principles of the present invention. Arrowhead 110 has a tip portion 120, a slotted ferrule 150, a set of blades 180 and a blade locking ring 190. As shown in FIGS. 2 and 2(*a*), tip portion 120 has a point 130, a cutting section 140, a first wedge section 142, and a chamfer section 144. Slotted ferrule 150 is coupled to tip portion 120 via a screw type attachment mechanism or other similar attachment mechanisms. A shaft portion 199, which is used to connect arrowhead 110 to arrow 100, is coupled to slotted ferrule 150 using conventional attachment mechanisms. A blade pivot screw 160 (shown also in FIG. 1(*d*)) rotatably locks blades 180 into slotted ferrule 150. Although a blade pivot screw is illustrated, other mechanisms could be utilized to rotatably couple blades 180 to slotted ferrule 150.

In the exemplary embodiment of the present invention, arrow 100 has three expandable blades 180 rotatably coupled to slotted ferrule 150. Although FIG. 1(*b*) shows three blades, the number of blades is variable. Blades 180 are arranged on slotted ferrule 150 such that the angles between each blade 180 are equal. For example, an arrow having three blades will have an angular separation of 120° between each blade and an arrow having four blades will have an angular separation of 90° between each blade. Referring now to FIG. 1(*c*), each blade 180 has a notch 182 and a rim 186 for holding blade locking ring 190 in a retaining position and a releasing position, respectively. Blade 180 has a generally right triangular shape, where the longest side represents faces outward. An ear 181 of blade 180 is at end adjacent to slotted ferrule 150 and includes notch 182 and rim 186.

As illustrated in FIG. 1(*e*), blade locking ring 190 is a split ring and can be constructed from rubber, plastics, elastomers, metals, spring stock and other appropriate materials. Alternatively, as shown in FIG. 1(*f*), blade locking ring 190' could be cylindrically shaped. The structure of the present invention minimizes outward projections by dimensioning the size of rim 186 to that of blade locking ring 190. The diameter of blade locking ring 190 and depth of notch 182 are selected to retain blades 180 in a closed position when blade locking ring 190 is situated in notch 182. The size selected must also permit displacement of blade locking ring 190 from notch 182 to rim 186 with the application of minimal force. This permits a greater portion of the force to be applied in the forward penetrating direction. Rim 186 is sized in accordance with the width of blade locking ring 190. This maximizes the aerodynamic characteristics of arrow 100.

Referring now to FIGS. 2 and 2(*a*), there is shown a tip portion 120 of arrow 100. As stated above, tip portion 120 has a cutting section 140 that has at least three or more sides that taper up from first wedge section 142 to form a point 130. Cutting section 140 has at least a length of 1.1 times a diameter D of first wedge section 142. Preferably, the length of cutting section 140 is at least two times the diameter of first wedge section 142. By maintaining the above ratio, the lower profile cutting section 140 can penetrate deeper and easier into the tougher areas, e.g., bone and cartilage, before allowing secondary levels of wedging action to separate the bone and cartilage. That is, cutting section 140 provides both a cutting action and a first level of wedging action. This permits tip portion 110 to penetrate further into the animal at impact. First wedge section 142 represents a second level of wedging action and further enlarges the entry/exit pathway for the blood of an animal. First wedge section 142 may be a cone, cylinder or other tapered shaft that has a round or geometrically shaped cross-section. As stated above, the diameter of first wedge section 150 is D, where D represents a range of diameters, for example, 0.10" to 1". However, the diameter could be of any width, as long as the length of cutting section 140 is at least 1.1 times the diameter D. At an opposing end of first wedge section 142 is chamfer section 144, which has a diameter D at first end 145 and a diameter of at least 1.1 times D at a second end 146. Chamfer section 142 also represents the starting of the third level of the wedging action and is the transition section to the outside surface of slotted ferrule 150. As such, slotted ferrule 150 represents a third level of wedging action and has a diameter at least equal to that of second end 146.

Figure 3:
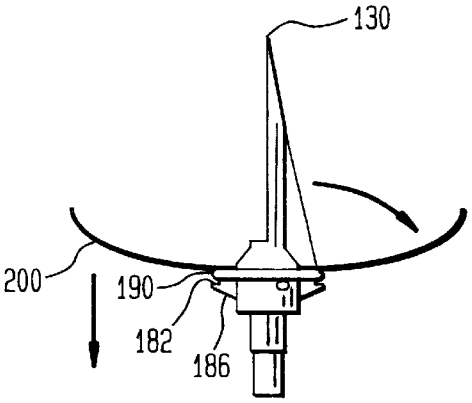
FIG. 3 illustrates an operational aspect of the present invention.
Figure 4:
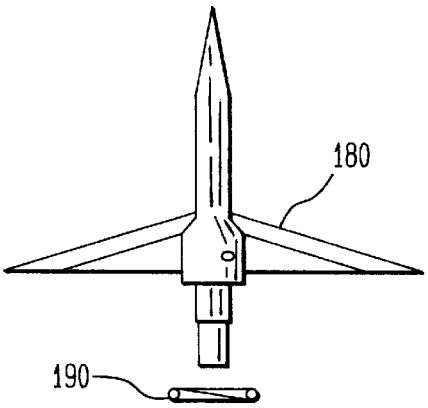
FIG. 4 illustrates a present invention arrowhead in a released position.

Operationally, with reference to FIGS. 3 and 4, point 130 first contacts a hide 200 of the animal being hunted. This results in a small hole on impact. As it proceeds through the animal, tip 130 starts cutting and initiates the first level of wedging action. This enlarges the entry/exit pathway. Penetration, cutting and initial wedging continues until first wedge section 142 makes contact with hide 200. The action now becomes predominantly a wedging or splitting action that transforms the initially small entry/exit pathway into a larger diameter pathway.

As arrow 100 proceeds through hide 200, blade locking ring 190 makes contact with hide 200, which forces blade locking ring 190 from notch 182 to rim 186. As shown in FIG. 4, as blade locking ring 190 hits rim 186, the continual forward force causes blades 180 to pivot open from the previously closed position. That is, the displacement of blade locking ring 190 from notch 182 to rim 186 results in releasing blades 180. Note that blades 180 open only after blades 180 are inside the target animal. As such, the available energy is not used by blades 180 to cut hide 200 and can be used for greater penetration into the animal. Blade locking ring 190 will be pushed onto shaft 199 for reuse by the hunter for the next attempt. Slotted ferrule 150 acts as a final wedging section to further enlarge the pathway as arrow 100 continues the penetration into the animal. As would be evident, the enlarging of the entry/exit pathway permits better bleed out of the animal and increases the chances of a kill. Furthermore, the triple wedging action mechanism permits deeper penetration, as there is less of a chance that bones and cartilage may impede the forward progress of the arrow. The lethality of the arrow and the chances of securing a kill are greater due to the present invention structure. The above factors make the present arrowhead a simple, accurate and effective device for hunting game.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claim is reserved.

What is claimed:

1. An arrowhead adapted for penetration of an object, said arrowhead comprising:

a slotted ferrule;

at least two blades, each of said blades having a notch and a rim;

said at least two blades rotatably coupled to said slotted ferrule; and a blade locking ring, said rim being sized relative to a width of said blade locking ring to achieve an aerodynamic profile, wherein said at least two blades are in a closed position when said blade locking ring is positioned in said notch and said at least two blades are in an open position when said blade locking ring is positioned at said rim, wherein said at least two blades go from said closed position to said open position after said arrowhead pierces a surface of said object, said surface of said object displacing said blade locking ring from said notch to said rim causing said at least two blades to pivot outward.

2. The arrowhead according to claim 1, wherein a size of said rim is approximate to a width of said blade locking ring.

3. The arrowhead according to claim 2, wherein said at least two blades pivot outward internal to said object.

4. The arrowhead according to claim 3, wherein an angular separation between said at least two blades is equal.

5. The arrowhead according to claim 4, wherein said arrowhead includes a tip portion, said tip portion including:

a first wedge section having a first diameter;

a cutting section having at least three sides tapering up from said first wedge section and terminating in a point; and a chamfer section having said first diameter at an end connected to said first wedge section and a second diameter at a second end;

said slotted ferrule having said second diameter at an end connected to said chamfer section, wherein after said point makes an opening at impact, said cutting section cuts and initiates a wedging action to enlarge said opening, and said first wedge section, said chamfer section and said slotted ferrule consecutively further enlarge said opening.

6. The arrowhead according to claim 5, wherein a blade pivot screw rotatably couples said at least two blades to said slotted ferrule.

7. The arrowhead according to claim 1, wherein said blade locking ring is a split ring.

8. The arrowhead according to claim 1, wherein said blade locking ring is a cylinder.

9. The arrowhead according to claim 1, wherein said blade locking ring is capable of being pushed onto a shaft portion for reuse by a hunter.

10. An arrow adapted for striking an object, comprising:

a tip portion;

a slotted ferrule coupled to said tip portion;

a plurality of blades rotatably coupled to said slotted ferrule, each of said plurality of blades having a ear proximate to said slotted ferrule;

each said ear having a notch and a rim; and a blade locking ring, wherein a size of said rim is approximate to a width of said blade locking ring, said blade locking ring retaining said plurality of blades when positioned in said notch and said blade locking ring releasing said plurality of blades when positioned at said rim, wherein said plurality of blades are released after said arrow penetrates a skin of said object to a given depth, said skin of said object displacing said blade locking ring from said notch to said rim causing said plurality of blades to pivot outward.

11. The arrow according to claim 10, wherein said plurality of blades pivot outward internal to said object.

12. The arrow according to claim 11, wherein an angular separation between said plurality of blades is equal.

13. The arrow according to claim 12, wherein said blade locking ring is capable of being pushed onto a shaft of said arrow for reuse by a user.

14. The arrow according to claim 13, wherein said blade locking ring is a split ring.

15. The arrowhead according to claim 13, wherein said blade locking ring is a cylinder.

16. An arrow having an arrowhead, said arrow adapted for penetrating hide of game, comprising:

a slotted ferrule;

a plurality of blades rotatably coupled to said slotted ferrule, each of said plurality of blades having a ear proximate to said slotted ferrule;

each said ear having a notch and a rim; and a blade locking ring, wherein said rim is sized relative to a width of said blade locking ring to achieve an aerodynamic profile, said blade locking ring retaining said plurality of blades when positioned in said notch and said blade locking ring releasing said plurality of blades when positioned in said rim, wherein said plurality of blades are released after said arrow penetrates said hide to a given depth inside said game, said hide displacing said blade locking ring from said notch to said rim causing said plurality of blades to pivot outward.

17. The arrow according to claim 16, wherein said rim is sized relative to a width of said blade locking ring to achieve an aerodynamic profile.

18. The arrow according to claim 16, wherein said blade locking ring is a split ring, said blade locking ring is capable of being pushed onto a shaft portion for reuse by a hunter, said hunter closing said plurality of blades, pulling apart said blade locking ring and placing onto each said notch.

* * * * *